US005123690A

United States Patent [19]

Bailey

[11] Patent Number: 5,123,690

[45] Date of Patent: Jun. 23, 1992

[54] D-RING FOR SLING SORTER

[75] Inventor: Warner Bailey, Wells, Tex.

[73] Assignee: NBS Trucking, Inc., Wells, Tex.

[21] Appl. No.: 795,710

[22] Filed: Nov. 21, 1991

Related U.S. Application Data

[63] Continuation-in-part of Ser. No. 589,635, Sep. 28, 1990, abandoned.

[51] Int. Cl.[5] ..... B66C 1/14

[52] U.S. Cl. ..... 294/74; 294/82.11

[58] Field of Search ..... 294/1.1, 74-76, 294/82.1-82.14; 24/115 R, 115 H, 115 K, 129 R, 129 B, 197-200; 59/84, 90, 91, 93

[56] References Cited

U.S. PATENT DOCUMENTS

| | | | |
|---|---|---|---|
| 3,153,828 | 10/1964 | Glover | 294/74 X |
| 3,352,590 | 11/1967 | Barthule | 294/74 |
| 3,583,750 | 6/1971 | Norton | 294/74 |
| 3,625,559 | 12/1971 | Lawrence | 294/74 |
| 3,915,487 | 10/1975 | Zeiler | 294/82.11 |
| 4,429,526 | 2/1984 | Rehbein | 294/82.1 X |

FOREIGN PATENT DOCUMENTS

| | | | |
|---|---|---|---|
| 2529467 | 1/1977 | Fed. Rep. of Germany | 294/74 |
| 2415598 | 9/1979 | France | 294/74 |
| 335923 | 9/1930 | United Kingdom | 294/82.1 |
| 1075518 | 7/1967 | United Kingdom | 294/74 |

*Primary Examiner*—Johnny D. Cherry

*Attorney, Agent, or Firm*—Pravel, Gambrell, Hewitt, Kimball & Krieger

[57] ABSTRACT

A D-ring for connecting the hook of a sling sorter to the webbing made of a metal plate and having a wear pad. An opening is formed in the plate for receiving the hook and a slot is formed near the base of the plate for receiving the webbing. The wear pad is placed between the opening and the slot and extends outward from the plate. The wear pad supports the weight of the D-ring when it is lying flat so that the webbing is not crushed between the D-ring and the ground.

15 Claims, 3 Drawing Sheets

D-RING FOR SLING SORTER

This application is a continuation-in-part of U.S. patent application Ser. No. 589,635, filed Sep. 28, 1990 now abandoned. The inventor listed in the present application is the sole named inventor in application Ser. No. 589,635.

BACKGROUND OF THE INVENTION

1. Field of the Invention

The invention relates to lumber sorting equipment, and more particularly to equipment for suspending slings on sling sorters.

2. Description of the Related Art

Like many businesses, the lumber industry has become highly mechanized. Machines convert forest timber to building lumber with minimal human assistance. The machines receive raw logs which are processed and cut to produce building lumber and a variety of other useful products. When this milling process is complete, the lumber must be sorted and packaged for delivery to users.

The modern sling sorter system, such as the Harvey Engineering and Manufacturing (HEMCO) inline planermill and green lumber sorting system, performs the lumber sorting operation rapidly and efficiently. A conveyor receives each board of lumber of assorted lengths. As the board is cut and trimmed to the particular specifications, a computer records the board's position on the conveyor.

The conveyor then moves the cut lumber along a set of parallel rails. The rails are divided into segments so that a set of segments may temporarily swing upward, creating an opening in the parallel rails. The segments are controlled by the computer. When a board of particular specifications reaches a point directly above a certain location on the rails, the rail segments are controlled by the computer. When a board of particular specifications reaches a point directly above a certain location on the rails, the rail segments automatically swing upward, and the board drops through the opening. The lumber is sorted by dropping all lumber of the same specification through the same opening, or additional bays, if required.

Beneath each opening are, typically, from two to five slings. The slings hang parallel to the rails across the opening, and are usually made of tough webbing. As the boards fall through the opening, they land on and are held by the slings.

One end of each sling is securely attached to a reel, or sling spool. The other end, which features a D-ring on which the sling webbing is permanently sewn, attaches to a hook which is permanently connected to the sorter structure. The reel, or sling spool, contains an amount of extra webbing. As the sling fills with lumber, the reel, or sling spool, is unwound so as to deliver more webbing, so that the sling remains essentially full without overloading. This feature minimizes damage to the boards by reducing the falling distance of the newly sorted lumber onto the lumber already being held in the sling.

The other end of each sling features a D-ring which attaches to a hook. When the sling is full and ready to be unloaded, the hook is withdrawn, thereby detaching the sling and allowing the sling to fall to the ground. After the sorted lumber is removed from the sling, the webbing is taken in again by the reel, or sling spool. The webbing passes through a metal retriever attached to the end of the reel, or sling spool. Once the reel, or sling spool, has pulled the sling webbing through the metal retriever until the D-ring is firmly fitted into the slot at the free end of the metal retriever, the retriever swivels upwards approximately 90 degrees so that it extends horizontally across the bay opening.

The hook is made to extend toward the reel, or sling spool, and catches the D-ring at the end of the webbing. The retriever and hook rotate back to their vertical hanging positions, with the sling hanging loosely between them. The sling is now ready to receive the next load of lumber.

Onto the end of the webbing which attaches to the hook is permanently sewn a metal D-ring. The D-ring, as the name indicates, is typically shaped like the letter "D" or is approximately triangular in shape. The end of the webbing loops over the base of the triangle and is securely sewn to itself. The hook catches the apex of the triangular D-ring to hold the sling and its lumber. When the hook is withdrawn, the D-ring falls to the ground. The webbing is reeled in until the D-ring contacts the metal retriever. After the retriever shifts to the horizontal position, the hook extends and lowers onto the D-ring as the sleeve swings back to the vertical position.

The D-ring does not always fall to the ground after being released by the hook. The D-ring often lands on the platform supporting the sorted lumber that has just been released by the sling. When this occurs, the D-ring must be pulled underneath the pile of lumber in the process of reeling in the webbing. The flat construction of the D-ring usually prevents significant damage to the lumber.

The webbing of the slings, especially the portion in the immediate vicinity of the D-ring, is subject to tremendous wear, and must periodically be replaced. The webbing usually wears out initially where it attaches to the D-ring. This is sometimes due to the sharp and rough edges of the D-ring which tear and weaken the webbing. The webbing is also damaged when the D-ring is dropped from the hook and hits the floor below. Many mills have concrete or other hard surface floors, and the webbing is often crushed between the floor and the falling D-ring. The webbing suffers further as it is dragged along the floor under the weight of the metal D-ring as the sling is reeled in to begin another load cycle. The webbing deteriorates even more rapidly when it is caught by and dragged under the pile of lumber.

The constant wear reduces the useful lifetime of the webbing. To prevent a failure, the webbing must be periodically replaced. This involves shutting down the entire sorter apparatus while the old sling is replaced. The mill must pay for the material and labor for the replacement, and the temporary loss of the entire sorter apparatus lowers the sorter system efficiency.

SUMMARY OF THE INVENTION

The present invention relates to an improved D-ring designed to prolong the life of the sling sorter webbing material. The D-ring has an opening in a metal plate to receive the hook and a slot in the plate for receiving the webbing. The webbing is protected by a wear pad located between the hole and the slot which protrudes from both sides of the plate. The wear pad prevents the metal plate from falling on the webbing and damaging it. The wear pad is shaped so as to prevent it from catching on or damaging boards when it is dragged under a pile of lumber.

BRIEF DESCRIPTION OF THE DRAWINGS

A better understanding of the present invention can be obtained when the following detailed description of the preferred embodiment is considered in conjunction with the following drawings, in which.

Figure 1:
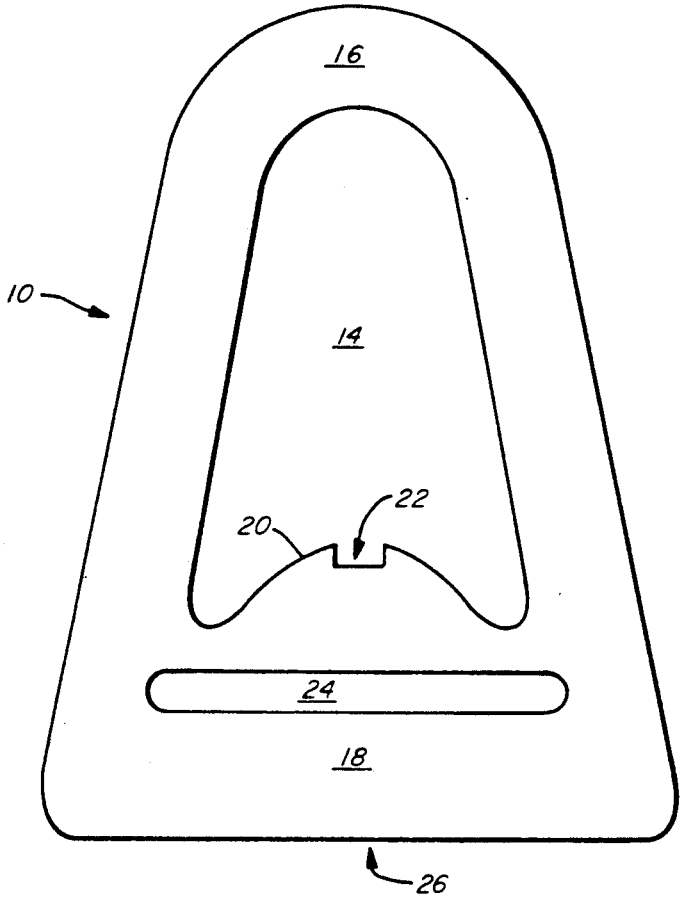
FIG. 1 illustrates a D-ring plate according to the present invention.
Figure 2:
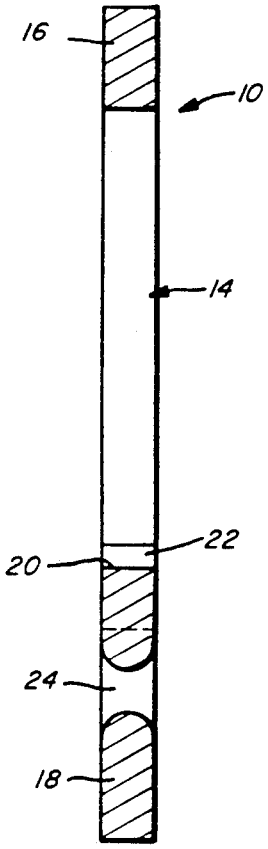
FIG. 2 illustrates a cross-section of the plate of FIG. 1.
Figure 4:
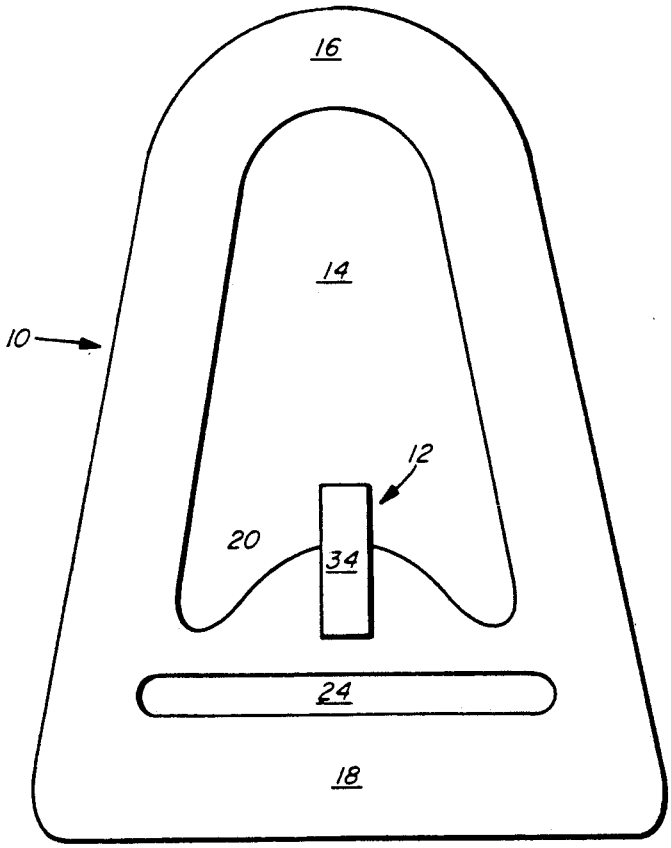
FIG. 4 illustrates a D-ring according to the present invention comprising the plate of FIG. 1 and the wear pad of FIG. 3.
Figure 5:
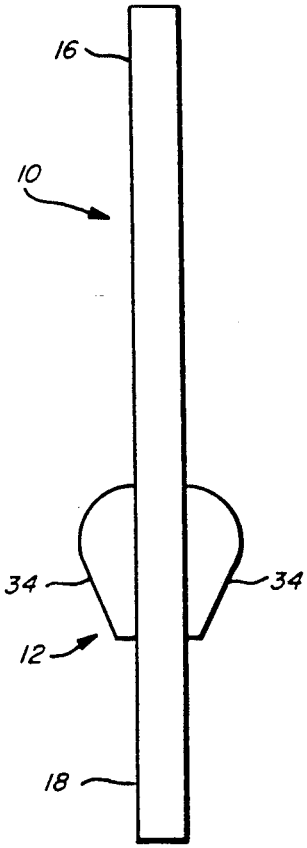
FIG. 5 illustrates a side view of the D-ring represented in FIG. 4.
Figure 6:
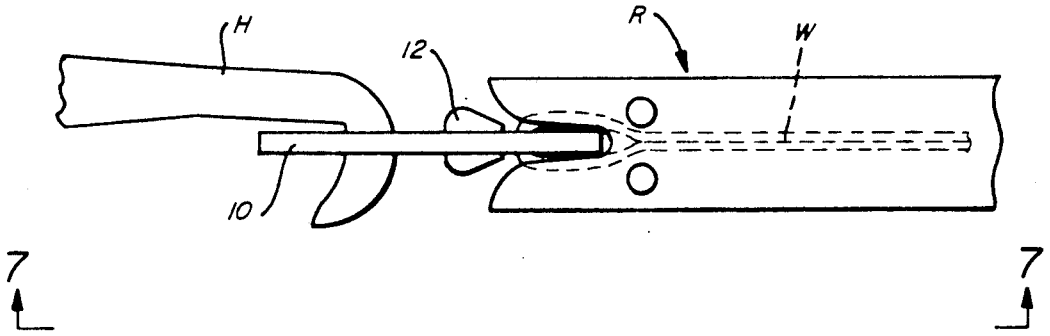
FIG. 6 illustrates a side view of the D-ring received in the sling sorter retriever and receiving the sling sorter hook.
Figure 7:
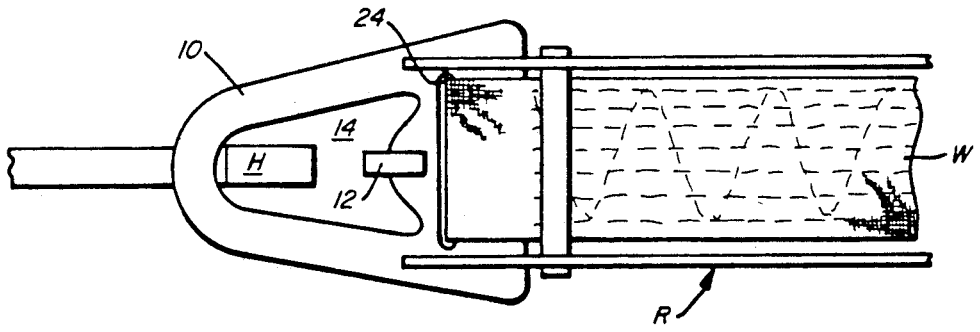
FIG. 7 illustrates a view taken along line 7—7 of FIG. 6.

DETAILED DESCRIPTION OF THE PREFERRED EMBODIMENT:

The preferred embodiment of a D-ring according to the present invention comprises an approximately triangular metal plate 10 and a wear pad 12 extending from the plane of the plate. The metal plate 10, shown in FIGS. 1 and 2, is substantially flat and has an opening 14 formed near its apex 16 capable of receiving the hook H of a sling sorter (FIGS. 6 and 7). Because the hook H is generally large and its movement imprecise, the opening 14 must be large enough to receive the hook H without a great deal of precise alignment. On the other hand, the opening 14 cannot be so large that the metal is too thin to support a heavy load of lumber. The edge of the opening 14 nearest the base 18 of the plate 10 includes a ridge Of metal 20 to support the Wear pad 12 (FIGS. 4 and 5). In one embodiment, the ridge 20 has an aperture 22 (FIG. 1) at its center to receive the Wear pad 12 shown in FIG. 3. Alternatively, the D-ring could be molded so that the wear pad 12 is integrally formed with the ridge 20 of the plate 10.

The plate 1O also features an elongated slot 24 formed between the opening 14 and the base 18 of the plate 10. The webbing W, as shown in FIGS. 6 and 7, is threaded through the slot 24 and then folded back over the base 18 of the plate 10 to form a loop. As shown in FIG. 7, the end of the webbing W is then securely sewn to a portion of the webbing w farther from the end to form a loop. To avoid cutting the webbing W, the edges of the plate 10 around the slot 24 are rounded or beveled. The long axis of the slot 24 is parallel to the base 18 of the metal plate 10. Further protection may be provided by providing a sleeve of abrasion resistant material, such as cordura, over that portion of the webbing in most intimate contact with the plate.

In the preferred embodiment, the elongated slot 24 has a length slightly greater than the width of the webbing W and a slot height only slightly greater than the thickness of the webbing W. The size of the slot 24 is important in preventing the formation of steel burrs around the perimeter of the slot 24 where the webbing w is in contact therewith. The preferred size of the slot 24 as above described minimizes the movement of the webbing W relative to the slot 24 which in turn greatly reduces the possibility of the webbing W being cut by burrs. Additionally, the preferred height of the slot 24 prevents movement of the webbing W relative to the longitudinal axis of the D-ring. This is very important in extending the life of the sling due to the fact that the webbing W does stretch after repeated use and the loop will also stretch. However, since the height of the slot 24 is the approximate thickness of the webbing W, the webbing W is securely held in the slot 24 and movement of the webbing w relative to the D-ring is minimized.

Figure 3:
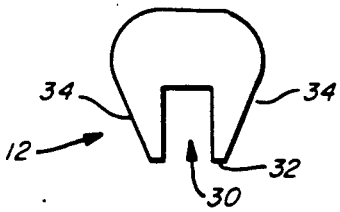
FIG. 3 illustrates a wear pad for a D-ring according to the present invention.

A wear pad 12 according to one embodiment of the present invention is shown in FIG. 3. The wear pad 12 is substantially flat and has an aperture 30 formed in its perimeter 32. The Wear pad aperture 30 mates with the aperture 22 in the ridge of metal 20 in the plate 10, as shown in FIGS. 4 and 5. The Wear pad 12 is welded to the ridge of metal 20 to secure it in position. In this position, the wear pad 12 extends perpendicularly from both faces of the metal plate 10 a distance which is greater than the accommodated webbing W that is looped through the elongated slot 24, thus providing protection for the webbing W. The wear pad 12 provides a landing surface so that whenever the D-ring lands flat beneath a pile of sorted lumber, the wear pad 12 prevents the D-ring plate 10 and the pile of lumber from crushing the webbing W. The wear pad 12 supports the weight of the D-ring so that it does not rest on the webbing W.

Because the D-ring must typically be dragged under a pile of lumber or over abrasive metal structure or rough concrete floors, the sides 34 of the wear pad 12 ramp outward as the wear pad 12 extends away from the slot 24. The ramped sides 34 prevent the Wear pad 12 from catching the lumber or other metal structures as the plate is dragged under a pile of lumber. The wear pad 12 is also fairly small relative to the lumber to prevent damage to the lumber as the D-ring is dragged underneath it or through it.

FIGS. 6 and 7 illustrate the D-ring as it is used with a sling sorter. One end of the webbing W is securely attached to a reel, or sling spool (not shown). The other end of the webbing w passes through a metal retriever R attached to the end of the sling spool. The webbing w is looped through the elongated slot 24 of the D-ring and is then permanently sewn to itself. The metal retriever R is allowed to rotate approximately 90 degrees downwardly during the lumber sorting procedure. After the sling webbing W has released a load of lumber, the sling spool retrieves the sling webbing w through the metal retriever R until the D-ring is firmly fitted in retriever slots at the free end of the metal retriever R. The retriever R then swivels upwardly approximately 90 degrees so that it extends horizontally across a bay opening of the sling sorter. Prior to any lumber being sorted, the hook H, which is rotatably connected to the sorter structure and is made to extend toward the D-ring, catches the D-ring which is being held in the retrieving slots of the retriever R as shown in FIGS. 6 and 7. The retriever R and hook H are then allowed to rotate back to their vertical hanging positions, with the sling webbing W hanging loosely between them. The sling webbing W is now ready to receive the next load of lumber. When the sling webbing W is full and ready to be unloaded, the hook H is withdrawn from the opening 14 of the D-ring, thereby detaching the D-ring and allowing the D-ring and the attached end of the sling webbing W to fall to the ground. The wear pad 12 protects the webbing w looped through the elongated slot 24 from damage as the D-ring hits the ground by maintaining the webbing W off of the ground. The webbing W is then reeled in by the sling spool. The wear pad 24 also minimizes damage to the webbing W as it is being reeled in and dragged beneath the pile of sorted lumber by maintaining a clearance both above and below the plate 10 and the attached webbing W, thus reducing the adverse effects of the webbing W being dragged between the ground and the rough lumber. After the D-ring is free of the sorted lumber, the sling spool reels the webbing W in until the D-ring is received in the retriever slots of the retriever R.

The foregoing disclosure and description of the invention are illustrative and explanatory, and various changes in the size, shape, and materials, as well as in the details in the construction, may be made without departing from the spirit of the invention.

I claim:

1. A D-ring, comprising:

a planar plate having an opening defined therethrough capable of disconnectedly attaching to a hook of a lumber sling sorter and a slot defined through said plate capable of permanently accommodating a webbing of the lumber sling sorter, said opening and said slot being divided by a ridgepiece, said plate having a longitudinal axis; and a planar wear pad having a longitudinal axis, and seated on a central portion of said ridgepiece between said opening and said slot, said wear pad having ramped sides extending substantially perpendicularly from said plate a distance which is greater than the distance the accommodated webbing extends substantially perpendicularly from said plate at said slot, wherein said wear pad is positioned so that the longitudinal axis of said wear pad substantially coincides with the longitudinal axis of said plate.

2. The D-ring of claim 1, wherein said plate is made of metal.

3. The D-ring of claim 1, wherein said wear pad ramps outward from said plate increasing in extent in a direction from said slot to said opening.

4. The D-ring of claim 1, wherein said slot is of such length and height to substantially inhibit movement of the webbing in said slot.

5. The D-ring of claim 4, wherein said slot has a length slightly greater than the width of the webbing and a height slightly greater than the thickness of the webbing.

6. A D-ring comprising:

approximately triangular planar plate having a base, an apex, a longitudinal axis between said base and said apex, an opening defined therethrough capable of disconnectedly attaching to a hook for a lumber sling sorter and an elongated slot defined through said plate substantially parallel to said base capable of permanently accommodating a webbing of the lumber sling sorter, said elongated slot and said opening being divided by a ridgepiece; and a planar wear pad having a longitudinal axis and seated on a central portion of said ridgepiece between said opening and said elongated slot, said wear pad having ramped sides tapering towards said elongated slot and terminating substantially adjacent to the webbing in said elongated slot, and positioned so that the longitudinal axis of said wear pad substantially coincides with the longitudinal axis of said plate, said wear pad extending approximately perpendicularly from said plate beyond the webbing accommodated at said elongated slot.

7. The D-ring of claim 6, wherein said plate is made of metal.

8. The D-ring of claim 6, wherein the edges of said plate surrounding said slot are rounded.

9. The D-ring of claim 6, wherein said ridgepiece has a greater height in the central portion than at the outer portions of said ridgepiece to provide increased seating area for said wear pad.

10. The D-ring of claim 9, wherein said wear pad is welded to said ridgepiece.

11. The D-ring of claim 9, wherein said central portion of said ridgepiece forms an aperture for receiving said wear pad.

12. The D-ring of claim 6, wherein said slot is of such length and width to substantially inhibit movement of the webbing in said slot.

13. The D-ring of claim !2, wherein said slot has a length slightly greater than the width of the webbing and a height slightly greater than the thickness of the webbing.

14. A D-ring comprising:

an approximately triangular metal planar plate having a base, an apex, a longitudinal axis between said base and said apex, an opening defined therethrough capable of disconnectedly attaching to a hook for a lumber sling sorter and an elongated slot defined through said plate substantially parallel to said base capable of permanently accommodating a webbing of the lumber sling sorter, said slot having a length slightly greater than the width of the webbing and a height slightly greater than the thickness of the webbing to substantially inhibit movement of the webbing in said slot, said elongated slot and said opening being divided by a ridgepiece; and a planar wear pad having a longitudinal axis and seated on a central portion of said ridgepiece between said opening and said elongated slot, said wear pad having ramped sides tapering towards said elongated slot and terminating substantially adjacent to the webbing in said elongated slot, and positioned so that the longitudinal axis of said wear pad substantially coincides with the longitudinal axis of said plate, said wear pad extending approximately perpendicularly from said plate beyond the webbing accommodated at said elongated slot, wherein said ridgepiece has a greater height in the central portion than at the outer portions of said ridgepiece to provide increased seating area for said wear pad.

15. A sling for a lumber sling sorter apparatus, comprising:

a webbing having a first and second end, said first end capable of being securely attached to the sling sorter apparatus; and a D-ring permanently secured to said second end of said webbing, said D-ring including an approximately triangular planar plate having a base, an apex, a longitudinal axis between said base and said apex, an opening defined therethrough capable of disconnectedly attaching to a hook for the lumber sling sorter apparatus and an elongated slot defined through said plate substantially parallel to said base capable of permanently accommodating said webbing, said elongated slot and said opening being divided by a ridgepiece, and a planar wear pad having a longitudinal axis and seated on a central portion of said ridgepiece between said opening and said elongated slot, said wear pad having ramped sides tapering towards said elongated slot and terminating substantially adjacent to said webbing in said elongated slot, and positioned so that the longitudinal axis of said wear pad substantially coincides with the longitudinal axis of said plate, said wear pad extending approximately perpendicularly from said plate beyond said webbing accommodated at said elongated slot.

* * * * *